US010443608B2

(12) United States Patent
Kobayashi et al.

(10) Patent No.: US 10,443,608 B2
(45) Date of Patent: Oct. 15, 2019

(54) IMPELLER

(71) Applicant: MITSUBISHI ELECTRIC CORPORATION, Chiyoda-ku (JP)

(72) Inventors: Hiroki Kobayashi, Chiyoda-ku (JP); Kosuke Umemura, Chiyoda-ku (JP); Sohei Samejima, Chiyoda-ku (JP); Kenichi Sakoda, Chiyoda-ku (JP); Haruhiko Kakutani, Chiyoda-ku (JP); Ichiya Takahashi, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 357 days.

(21) Appl. No.: 15/081,187

(22) Filed: Mar. 25, 2016

(65) Prior Publication Data

US 2016/0290138 A1 Oct. 6, 2016

(30) Foreign Application Priority Data

Mar. 30, 2015 (JP) ..... 2015-069169
Jan. 22, 2016 (JP) ..... 2016-010774

(51) Int. Cl.
*F01D 5/14* (2006.01)
*F01D 5/30* (2006.01)
*F04D 29/34* (2006.01)

(52) U.S. Cl.
CPC ..... *F04D 29/34* (2013.01); *F05D 2260/36* (2013.01); *F05D 2300/603* (2013.01)

(58) Field of Classification Search
CPC ..... F04D 29/02; F04D 29/023; F04D 29/026; F04D 29/322; F04D 29/34; F01D 5/3015; F01D 5/3069; F05D 2300/603
See application file for complete search history.

(56) References Cited

U.S. PATENT DOCUMENTS 2,354,101 A * 7/1944 Broders ..... F04D 29/34 416/134 R
5,096,384 A * 3/1992 Immell ..... B29C 70/345 156/172
6,139,277 A * 10/2000 Lopatinsky ..... F01D 5/3015 416/220 A

FOREIGN PATENT DOCUMENTS

JP 63-134900 A 6/1988
JP 4-32298 A 3/1992
(Continued)

OTHER PUBLICATIONS

Combined United Kingdom Office Action and Search Report dated Sep. 30, 2016 in Patent Application No. GB1605236.7.
(Continued)

*Primary Examiner* — Jason D Shanske
*Assistant Examiner* — Julian B Getachew
(74) *Attorney, Agent, or Firm* — Oblon, McClelland, Maier & Neustadt, L.L.P.

(57) ABSTRACT

The impeller includes a blade formed either entirely or partially from fiber reinforced plastic, a boss member that supports the blade, a plate that presses a root portion of the blade against the boss member; and a fastening portion that fastens the boss member to the plate, wherein the root portion of the blade has an undercut shape, the boss member has an excavated portion, the excavated portion is shaped identically to all or a part of the undercut shape or shaped such that a gap is formed between the excavated shape and all or a part of the undercut shape, and the root portion of the blade is fastened by a fastening force via the boss portion and the plate in a condition where a clearance is provided between the boss member and the plate.

8 Claims, 7 Drawing Sheets

(56) References Cited

FOREIGN PATENT DOCUMENTS

| | | | |
|---|---|---|---|
| JP | 6-500157 | A | 1/1994 |
| JP | 11-182494 | | 7/1999 |
| JP | 2008-232151 | | 10/2008 |
| JP | 5016482 | | 9/2012 |
| WO | WO 2010/061195 | A1 | 6/2010 |
| WO | WO 2015/171446 | A1 | 11/2015 |

OTHER PUBLICATIONS

Office Action dated Jul. 24, 2018 in corresponding Japanese Patent Application No. 2016-010774 (with English Translation), 7 pages.

* cited by examiner

IMPELLER

BACKGROUND OF THE INVENTION

1. Field of the Invention

This invention relates to an impeller used in a blower, for example.

2. Description of the Related Art

In an axial flow impeller, which is often used in a blower, a plurality of blades are coupled to a boss member in the vicinity of a rotary shaft, and the plurality of blades are rotated together with rotation of the shaft in order to suction gas from an axial direction and blow the gas in the axial direction. The blades must be coupled to the boss member so that while rotating, the blades can withstand a centrifugal force generated in a radial direction relative to the rotary shaft. To realize a higher capacity blowing performance, a larger impeller that can withstand a centrifugal force generated at a higher rotation speed is required.

Fiber Reinforced Plastics (FRP), and particularly Carbon Fiber Reinforced Plastics (CFRP), are compound materials with which high specific strength and high specific rigidity can be realized. An impeller using fiber reinforced plastic exhibits high specific strength and high specific rigidity, and does not therefore break or undergo dramatic deformation. Hence, an impeller using fiber reinforced plastic is useful for realizing a larger blower that is capable of rotating at high speed and achieves a high capacity blowing performance (see Japanese Patent Application Publication No. H6-212904, for example).

Meanwhile, a method of providing through holes in the blades so as to fasten the blades to the boss member by bolts is often used as a method of coupling the plurality of blades. With this method, the blades can be fixed by a fixing force generated in response to contact between a bolt wall surface and a hole wall surface and a frictional force generated in response to an axial force of the bolt, and as a result, a large fixing force is obtained. However, blades formed from FRP exhibit particularly strong anisotropy, and therefore, when these blades are fastened, stress may be concentrated in a large amount on the periphery of the through holes in the blades, causing the blades to break.

In response to this problem, a method of coupling the blades to the boss member without using a bolt fastening structure in which a through hole is formed in the blade may be employed (see Japanese Patent Publication No. 5016482, for example). In this method, an undercut shape is provided on a root of the blade, a shape into which the undercut fits is formed in the boss member, and the two shapes are fitted together. With this method, stress concentration can be alleviated in comparison with a case in which a through hole is provided, and therefore a large impeller that rotates at high speed can be obtained.

SUMMARY OF THE INVENTION

In Japanese Patent Publication No. 5016482, however, a hub contacts a pressing plate, and therefore a force for fastening the root portions of the blades is either small or completely nonexistent. Hence, sufficient frictional force for fixing the blades is not obtained, making further increases in size and rotation speed impossible.

This invention has been designed to solve the problem described above, and an object thereof is to obtain an impeller in which a fixing force for fixing a blade is increased, enabling further increases in the size and rotation speed of the impeller.

To achieve the object described above, this invention is an impeller including a blade formed either entirely or partially from fiber reinforced plastic, a boss member that supports the blade, a plate that presses a root portion of the blade against the boss member, and a fastening portion that fastens the boss member to the plate, wherein the root portion of the blade has an undercut shape, the boss member has an excavated portion for receiving the root portion of the blade, the excavated portion is shaped identically to all or apart of the undercut shape or shaped such that a gap is formed between the excavated shape and all or apart of the undercut shape when the excavated portion receives the root portion of the blade, and the root portion of the blade is fastened by a fastening force via the boss portion and the plate in a condition where a clearance is provided between the boss member and the plate.

According to this invention, the blade is fitted to the boss member, and therefore a fixing force acts on the blade so as to prevent the blade from moving in a radial direction relative to a rotary axis in response to a centrifugal force. Moreover, the root portion of the blade is fastened by the axial force of a bolt, and therefore the blade is constrained by a fixing force generated by friction. Hence, the impeller can withstand a larger centrifugal force than a conventional impeller in which the blade is coupled by fitting alone.

BRIEF DESCRIPTION OF THE DRAWINGS

Figure 1:
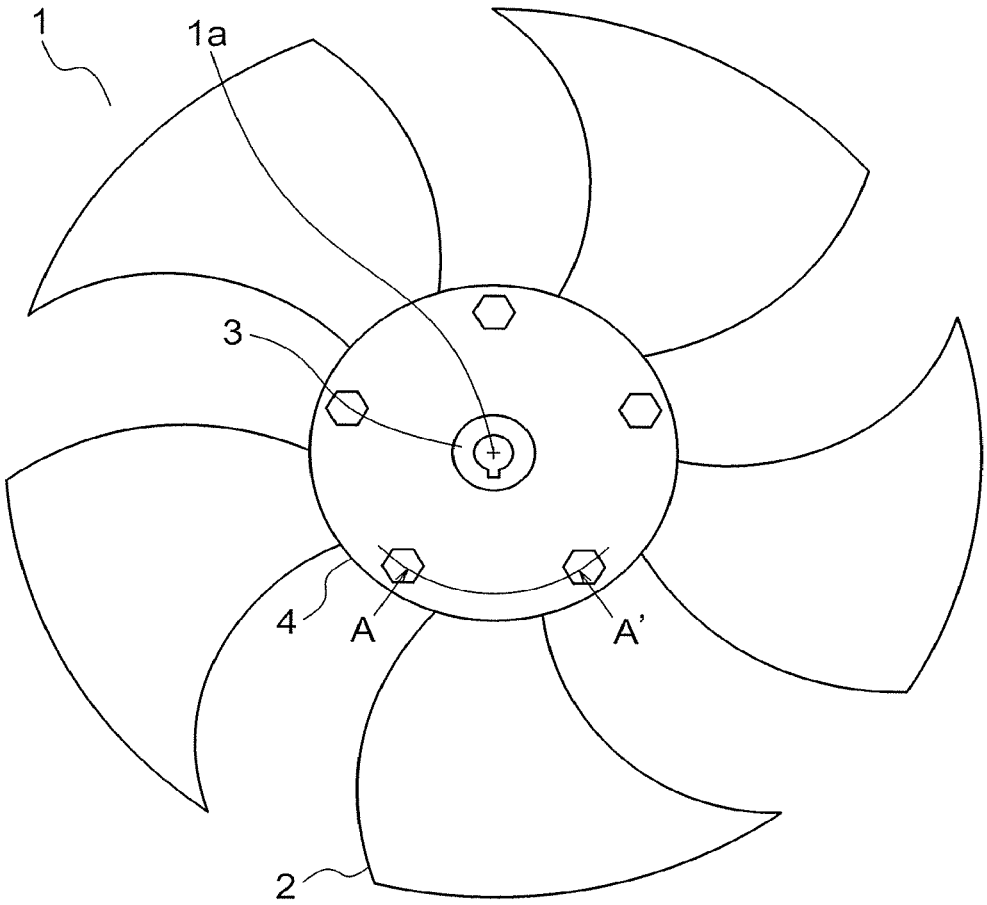
FIG. 1 is a front view showing an impeller according to a first embodiment of this invention.

Embodiments of this invention will be described below on the basis of the attached drawings. Note that in the drawings, identical reference numerals denote identical or corresponding parts.

First Embodiment

Figure 2:
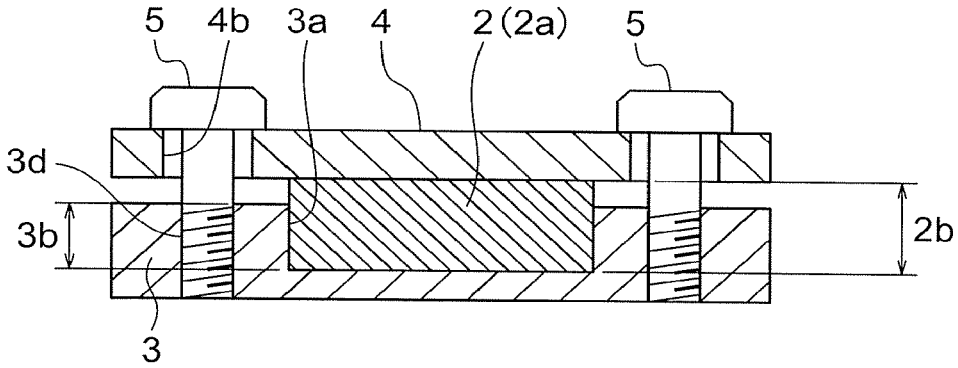
FIG. 2 and FIG. 2A are views showing a cross-section taken along an A-A' line in FIG. 1.
Figure 2A:
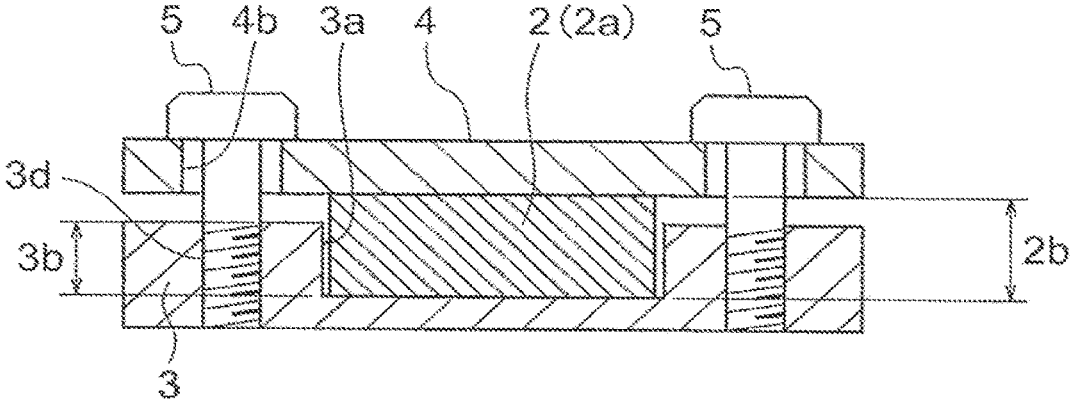
Figure 3:
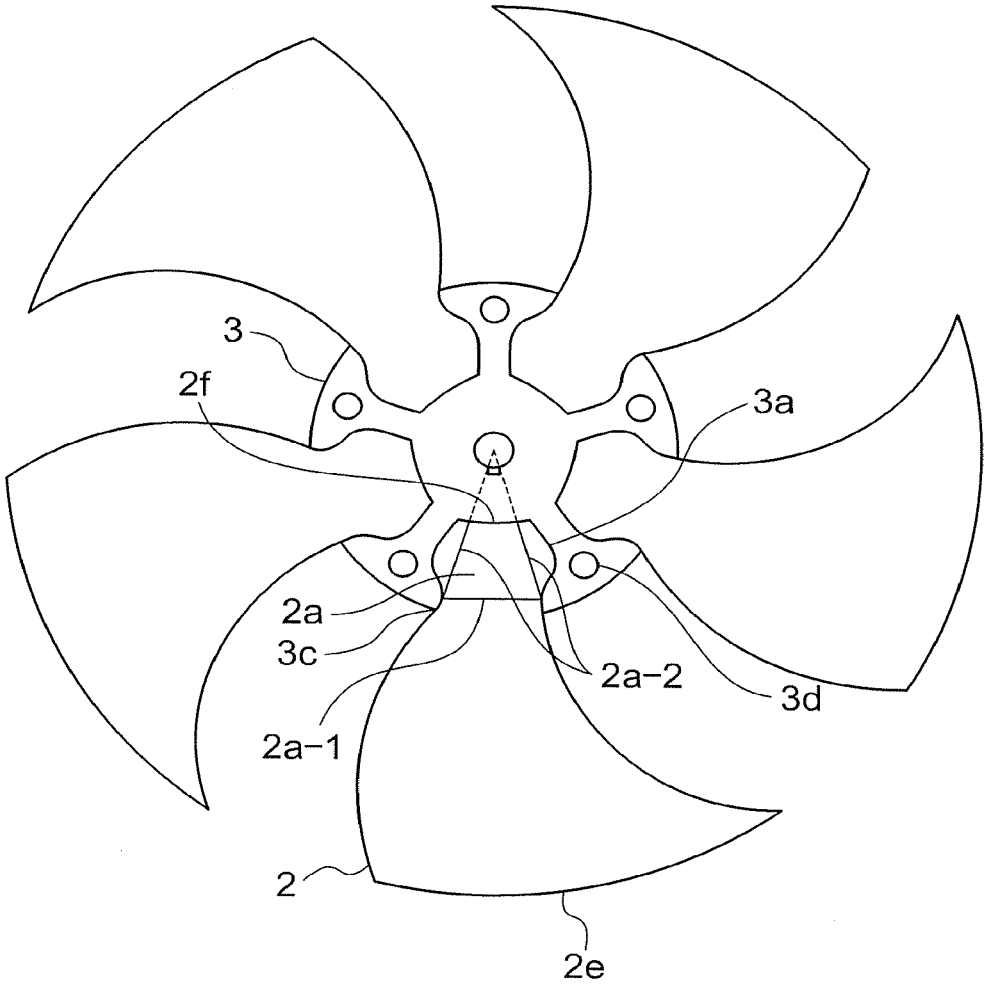
FIG. 3 is a front view showing the impeller of FIG. 1 without a pressing plate and bolts.

FIG. 1 is a front view showing an impeller 1 according to a first embodiment of this invention, and FIG. 2 and FIG. 2A are views showing a cross-section taken along an A-A' line in FIG. 1. FIG. 3 is a front view showing a condition in which a pressing plate 4 and bolts 5 shown in FIG. 1 have been removed.

The impeller 1 according to the first embodiment of this invention includes a plurality of blades 2, each having an undercut shape in a root portion 2*a* thereof, a boss member 3 that includes excavated portions shaped either identically to the undercut shapes of the blades 2 or such that a predetermined gap is formed between the excavated portions and the undercut shapes of the blades 2, and that is fitted to the blades 2 so as to prevent the blades 2 from becoming dislodged in a radial direction relative to a rotary axis, a pressing plate 4 that presses the respective roots of the blades 2 against the boss member 3, and a plurality of bolts 5 for fastening the boss member 3 to the plate 4.

Root portions 2*a* of the blades 2 are fastened by a bolt axial force exerted thereon via the boss member 3 and the pressing plate 4 in a condition where a clearance is provided between the boss member 3 and the pressing plate 4.

The impeller 1 includes five blades 2, and the respective root portions 2*a* of the blades are fitted into excavated portions 3*a* of the boss member 3. The bolt 5 passes through a hole 4*b* in the pressing plate 4 such that a male screw (a fastening portion) provided thereon is screwed to a female screw 3*d* (the fastening portion) provided in the boss member 3, and the root portion 2*a* of the blade is fixed in a fastened condition by a resulting axial force. A gap is provided between an inner surface of the hole 4*b* in the pressing plate 4 and an outer surface of the bolt 5, and a screw groove does not exist therein.

The blade 2 is formed in a predetermined shape so as to obtain a predetermined aerodynamic characteristic. When the impeller 1 rotates about a rotary shaft 1*a*, the blades 2 push out air in a perpendicular direction to the paper surface of FIG. 1 while receiving a centrifugal force in a radial direction relative to the rotary shaft 1*a*. Here, the number of blades is set at five, but there are no particular limitations thereon, and the blades may be provided in any number with which the predetermined aerodynamic characteristic is obtained.

The blade 2 is formed entirely or partially from fiber reinforced plastic (FRP). In other words, from the viewpoints of specific strength and specific rigidity, FRP is preferably employed as the material of the blade 2. A material with which a predetermined performance can be obtained is selected as a resin of the FRP, but here, from the viewpoints of strength and rigidity, vinyl ester is used. Alternatively, a favorable performance is obtained with epoxy, unsaturated polyester, furan, polyurethane, polyimide, polyamide, polyether ether ketone, polyether sulfone, polypropylene, polyester, polycarbonate, acrylonitrile styrene, acrylonitrile butadiene styrene, i.e. so-called ABS, and modified polyphenylene ether. The resin may be blended with an additive or a filler in order to realize the predetermined performance.

A material with which a predetermined performance can be obtained is selected as the reinforced fiber of the FRP, but carbon fiber, which exhibits superior strength and rigidity and has a low specific gravity, is preferable. Other types of reinforced fiber with which a favorable performance is obtained include glass fiber, aramid fiber, Kevlar® fiber, boron fiber, alumina fiber, and stainless steel fiber.

Fiber reinforced plastic can generally be manufactured easily with an aluminum honeycomb structure or a sandwich structure having foamed resin or the like as a core. With this structure, the weight of the blades can be reduced, and as a result, centrifugal force generation can be suppressed effectively. In the first embodiment, however, the root portion 2*a* preferably has a favorable structure for withstanding the fastening action applied by the axial force (a fastening force) of the bolt 5, and therefore the root portion 2*a* (in particular the part that is fastened) of the blade 2 has a solid structure filled with the FRP material rather than a structure in which a core material is sandwiched by the FRP material. Here, from the viewpoint of moldability, the entire blade 2 is provided with a solid structure.

Favorable strength and rigidity are obtained in the reinforced fiber when one or a combination of unidirectional continuous fiber, textile fiber, short chopped fiber, and milled fiber is used. FRP formed by molding a compound containing chopped fiber in a pressing machine is particularly easy to mold in a thick, solid form, and is therefore particularly useful for suppressing breakage of the blade 2.

A constriction, or in other words the undercut shape, is provided on the root portion 2*a* of the blade in order to constrain radial direction movement of the blade about the rotary axis. When the undercut shape is viewed on a two-dimensional shape drawn on a plane that is perpendicular to the rotary axis of the impeller and a circumferential direction width of the blade is regarded as a course extending from a blade outer periphery 2*e* to a blade root end 2*f*, the undercut shape includes a shape having a width that initially narrows gradually from the blade outer periphery 2*e* toward the blade root end 2*f* and then widens. By including this shape in the undercut shape, a structure with which the blade is prevented from becoming dislodged by the centrifugal force can be realized.

Here, the undercut shape is provided on a perpendicular plane to the rotary axis, but the undercut shape may be tilted relative to a perpendicular plane to the rotary axis.

The excavated portion 3*a* of the boss member 3 is a recess formed in a blade side surface, or in other words a pressing plate side surface, of the boss member 3. When the recess of the excavated portion 3*a* is viewed on a two-dimensional shape drawn on a plane that is perpendicular to the rotary axis of the impeller, the recess has either a contour that is shaped identically to all or a part of the undercut shape of the root portion 2*a* of the blade or a contour provided with a predetermined tolerance relative to all or a part of the undercut shape.

In a condition where the root portion 2*a* of the blade is inserted into the excavated portion 3*a* of the boss member, or in other words in a so-called fitted condition, the bolt 5 passed through the hole 4*b* in the pressing plate 4 is inserted into the female screw 3*d* provided in the boss member 3 such that the root portion 2*a* of the blade is fixed in a fastened condition by the axial force thereof. At this time, a height 3*b* of the excavated portion 3*a* of the boss member is lower than a thickness 2*b* of the root portion of the blade. In other words, a clearance is provided between the pressing plate 4 and the boss member 3. Therefore, the axial force of the bolt 5 is transmitted entirely to the root portion 2*a* of the blade such that the blade is fixed by the fastening force while contacting the boss member 3 and the pressing plate 4. The diameter, material, and number of the bolts 5 may be selected in order to obtain an appropriate axial force P, as will be described below, but here, to ensure that the five blades 2 respectively receive identical fastening forces and to suppress imbalance when the impeller rotates, five bolts, i.e. the same number of bolts 5 as the number of blades 2, are disposed at equal intervals. The five bolts 5 are disposed in positions avoiding the excavated portions 3*a* of the boss member 3, and therefore a through hole does not need to be provided in the base portion 2*a* of the blade. Note that the bolts may be provided in a larger number than the number of blades, and are preferably disposed in locations not penetrating the blades.

Accordingly, a frictional force that constrains movement of the blade 2 in response to the centrifugal force is generated in the blade 2 in proportion with the axial force of the bolt 5, and as a result, the blades 2 can withstand a greater centrifugal force than a blade that is simply fixed by fitting.

Hence, in the impeller according to the first embodiment, a through hole is not provided in the root portion 2*a* of the blade, and therefore breakage caused by stress concentration can be suppressed.

Specifically, the size of the clearance is preferably set between 5% and 15% of the root portion thickness 2*b* of the blade. By setting the clearance at no less than 5%, the clearance remains between the boss member 3 and the pressing plate 4 even when compressive creep deformation occurs in the blade root portion 2*a* due to the fastening force, and therefore the axial force can be applied continuously to the root portion 2*a* of the blade. Further, by setting the clearance at no more than 15%, a large contact area can be secured between a wall of the excavated portion 3*a* and the root portion 2*a* of the blade, and as a result, compression fractures in the root portion 2*a* of the blade can be suppressed. Here, when the thickness of the blade root portion 2*a* is uneven, the clearance is preferably set between 5% and 15% of a minimum value thereof.

The undercut shape of the root portion 2*a* is preferably configured such that a ratio between a surface area of a narrowest plane 2*a*-1 of a cross-section that is orthogonal to the radial direction centering on the rotary axis and a total surface area of a plane 2*a*-2 of a cross-section that is orthogonal to the circumferential direction centering on the rotary axis, wherein the plane 2*a*-2 passes through a fitting portion tip end 3*c* of the boss member and is parallel to the radial direction centering on the rotary axis, is twice as large as a ratio of a circumferential direction tensile strength and a radial direction tensile strength of the material forming the root portion 2*a* of the blade. When the ratio is set at a value much smaller than a multiple of two, for example 0.2, a shear fracture occurs in the plane 2*a*-2, leading to a reduction in the centrifugal force that can be withstood by the blade. Further, when the ratio is set at a value much larger than a multiple of two, for example 20, a tensile fracture occurs in the narrowest plane 2*a*-1 of the cross-section that is orthogonal to the radial direction centering on the rotary axis, leading to a reduction in the centrifugal force that can be withstood by the blade. When the ratio is set at a multiple of two, these two types of fractures occur substantially simultaneously, and therefore the most favorable performance is obtained within a range of a multiple of 0.5 to a multiple of 10.

The root portion 2*a* of the blade is formed from FRP obtained by molding a compound containing chopped fiber in a pressing machine, and the entire blade is solid. Therefore, compression fractures and compressive creep are less likely to occur in response to a large fastening force than in a blade having a sandwich structure. More specifically, the blade is preferably set at no more than 120 N/mm2. This numeral is based on a known numeral set as a limit surface pressure of FRP in the field of research into high-strength bolts (for example, disclosed by the Japan Research Institute for Screw Threads and Fastenings in MARUYAMA Kazuo, KASEI Shinji, SAWA Toshiyuki (translation) (1989): VDI 2230 Blatt 1 (1986) Systematic calculation of high-duty bolted joints, p. 55).

Further, when a fastening pressure is too small, the frictional force decreases, and as a result, a large fixing force is not obtained. More specifically, the blade is preferably fastened using a force at which the frictional force can withstand the centrifugal force. A corresponding range can be expressed by a following expression, using P as an axial force per blade, m as a mass per blade, r as a distance between the center of gravity of the blade and the rotary axis, ω as a maximum rotation speed, α as a coefficient provided in consideration of a temporal reduction in the axial force and a friction coefficient so that the impeller can be operated without breaking during a period of use, S as the smaller surface area of a projected area of a surface that is fastened from the boss member 3 side and a projected area of the surface that is fastened from the pressing plate 4 side, and β as a limit pressure.

$$\alpha m r \omega^2 < P < \beta S$$

In this embodiment, when m=0.5 [kg], r=0.125 [m], ω=125 [rad/sec], α=5, S=0.003 [$m^2$], β=120000000 [$N/m^2$], and the unit of the axial force P per blade is set as [N], $$4{,}883 < P < 360{,}000$$

is most preferable.

Here, α was set at α=5 by performing a durability test on the impeller. When α is set at a much smaller value than 5, the effect of increasing the centrifugal force that can be withstood is smaller than in a case where the blade is fixed by fitting alone. When α is set at a much larger value than 5, a large number of bolts having a large bolt diameter are needed to generate the required axial force, leading to an undesirable increase in the weight of the impeller. Specifically, a range of 3 to 7, with 5 as the optimum value, is preferably employed.

Further, by setting a range of $$0.5\beta S < P < \beta S$$

when the lower limit exceeds 0.5 times the upper limit in the above expression, it is possible to make maximum use of the frictional force within a range where compression fractures and compressive creep are unlikely to occur, with the result that the blades can withstand a larger centrifugal force than blades that are fixed by fitting alone.

Figure 4:
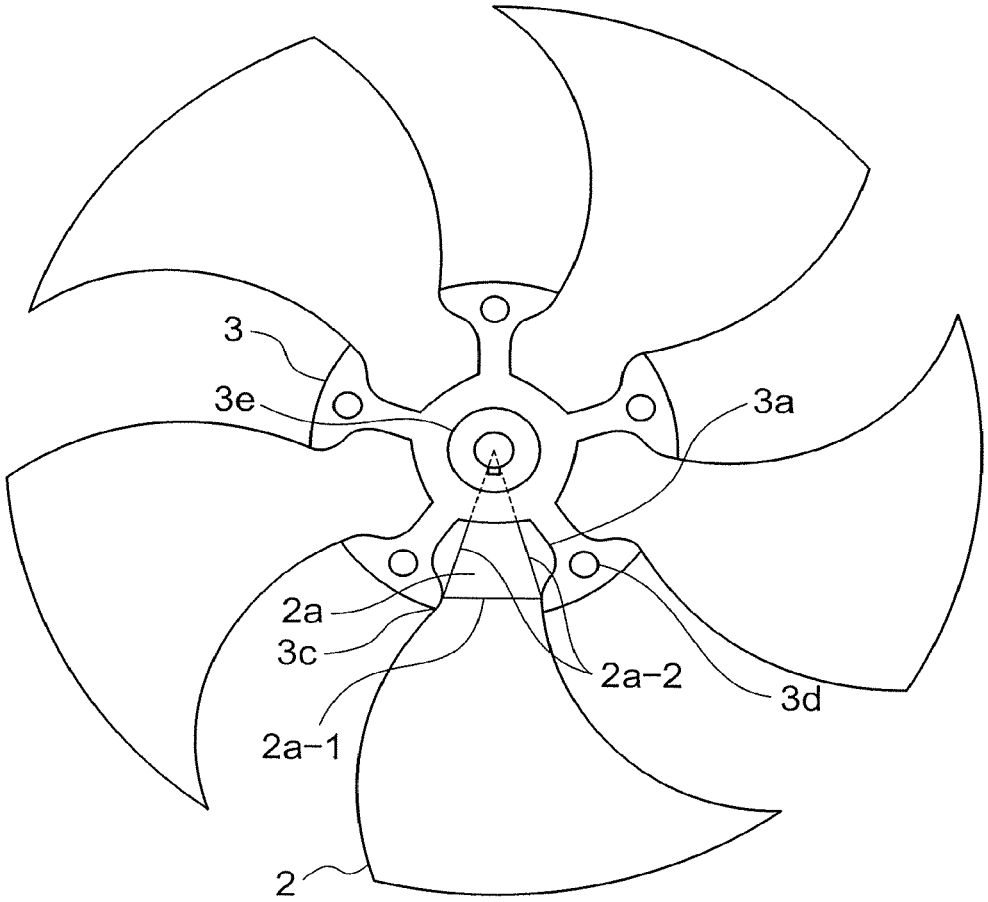
FIG. 4 is a front view showing the impeller according to the first embodiment of this invention in a case where a male screw is provided in a central portion of a boss member.
Figure 5:
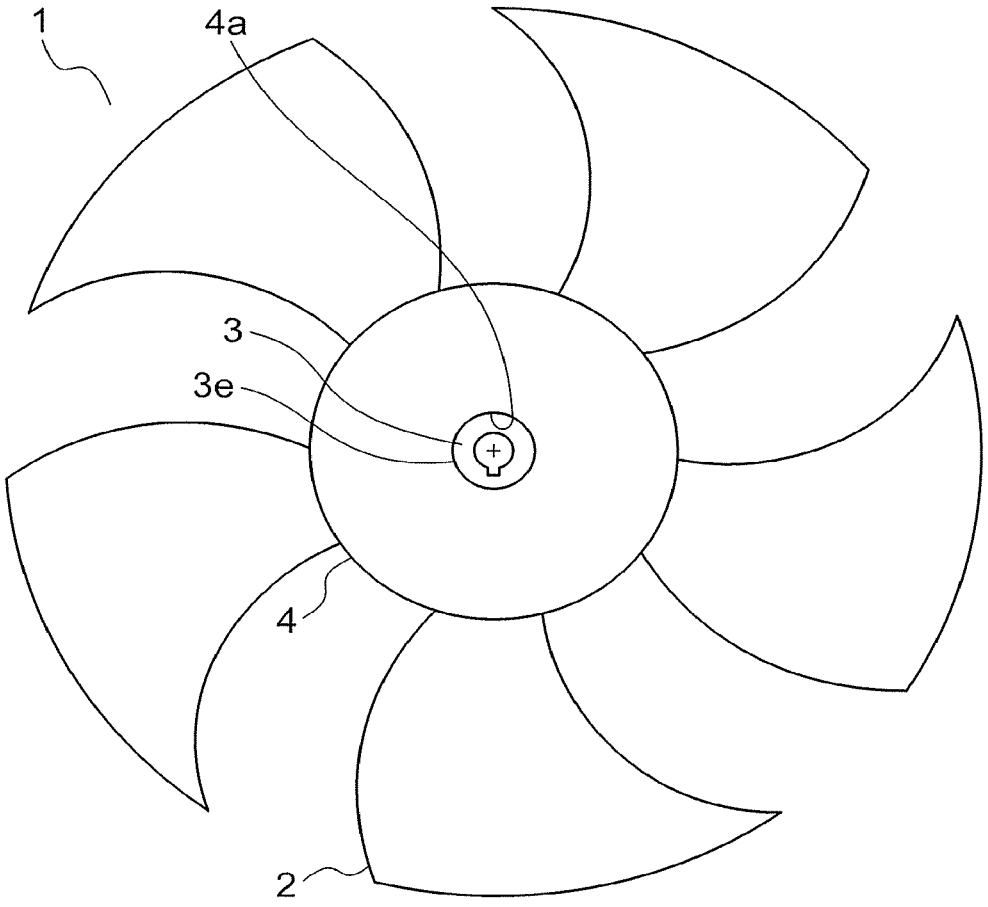
FIG. 5 is a front view showing the impeller according to the first embodiment of this invention in a case where a male screw is provided in the central portion of the boss member and an axial force is applied to a root portion of a blade by fastening the male screw to a female screw provided in a central portion of the pressing plate.

An example in which the root portions of the blades are fastened using bolts was described above, but this invention is not necessarily limited thereto, and the root portions of the blades may be fastened using another method. For example, a male screw 3*e* (the fastening portion) may be provided in a central portion of the boss member 3, as shown in FIG. 4, and an axial force (the fastening force) may be applied to the root portion 2*a* of the blade by fastening the male screw 3*e* to a female screw 4*a* (the fastening portion) provided in a central portion of the pressing plate 4, as shown in FIG. 5.

Second Embodiment

Figure 6:
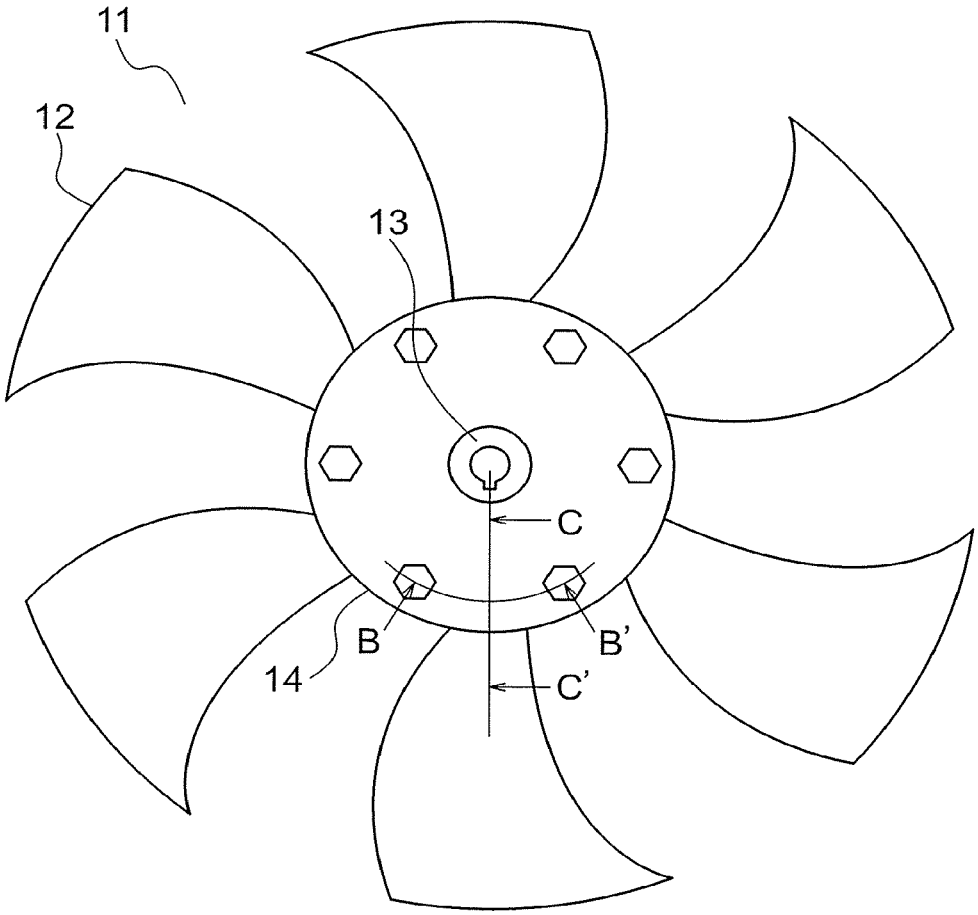
FIG. 6 is a front view showing an impeller 11 according to a second embodiment of this invention.
Figure 7:
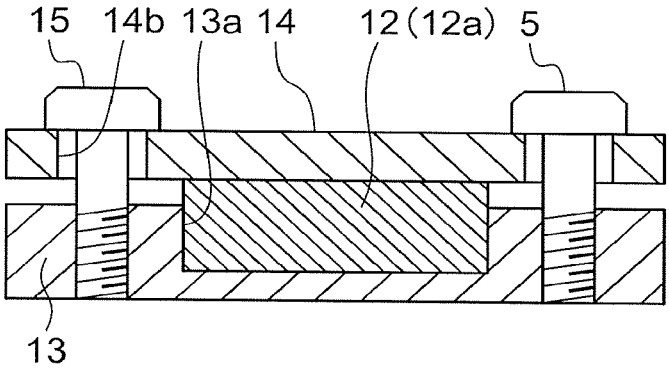
FIG. 7 is a view showing a cross-section taken along a B-B' line in FIG. 6.
Figure 8:
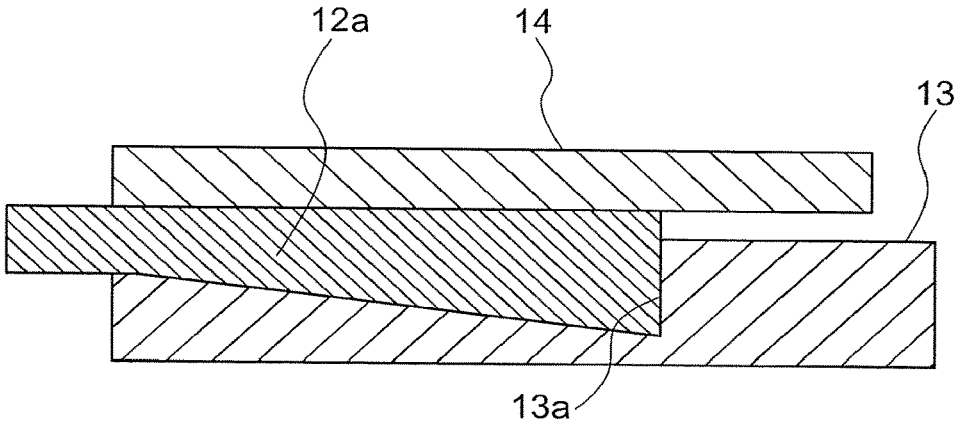
FIG. 8 is a view showing a cross-section taken along a C-C' line in FIG. 6.
Figure 9:
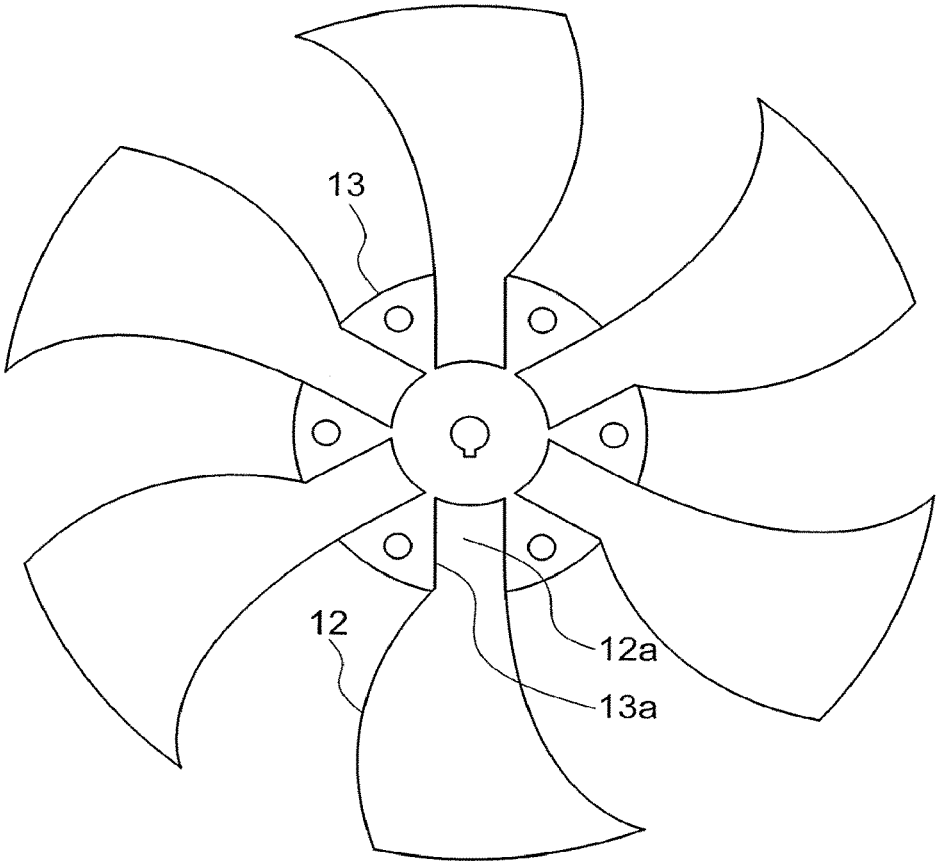
FIG. 9 is a front view showing the impeller of FIG. 6 without a pressing plate and bolts.

Next, using FIGS. 6 to 9, a second embodiment of this invention will be described. FIG. 6 is a front view showing an impeller 11 according to the second embodiment of this invention. FIG. 7 is a view showing a cross-section taken along a B-B' line in FIG. 6. FIG. 8 is a view showing a cross-section taken along a C-C' line in FIG. 6. FIG. 9 is a front view showing the impeller of FIG. 6 without a pressing plate and bolts. Note that the second embodiment is assumed to be identical to the first embodiment except for the content described below.

Six blades 12 are provided. When the impeller is viewed from a plane that is perpendicular to a rotary axis direction (a plane having the rotary axis as a perpendicular), a surface area of a boss member 13 that can be used for each blade is smaller in the second embodiment than in the first embodiment. Here, when a sufficient surface area can be secured in the boss member, as in the first embodiment, the boss member can be improved in productivity by providing undercut shapes as fastening portions in the plane that is perpendicular to the rotary axis direction. In the second embodiment, however, it is necessary to economize on the surface area, and therefore undercut shapes are preferably provided in root portions 12*a* of the blades on a plane that is perpendicular to a rotary circumference direction, as shown by the C-C' cross-section. The blades 12 are formed from FRP, and can therefore be formed in a shape having a thickness distribution without the need for exceptionally complicated processes. For example, the target undercut shape can be obtained by molding using a sheet molding compound method, i.e. a so-called SMC method, with a die in which a cavity provided in a location that corresponds to the C-C' cross-section following molding serves as the undercut shape.

The boss member 13 includes excavations 13*a* configured to receive the undercut shapes on the root portions 12*a* of the blades, and is fitted to the blades 12 so as to prevent the blades 12 from becoming dislodged in the radial direction relative to the rotary axis. A pressing plate 14 is a simple plate formed from a plane that is perpendicular to the rotary axis direction, and is therefore obtained easily without the need for complicated processing.

The root portions 12*a* of the blades 12 are fastened by a bolt axial force via the boss member 13 and the pressing plate 14 in a condition where the clearance is provided between the boss portion 13 and the pressing plate 14.

The content of this invention was described specifically above with reference to preferred embodiments, but on the basis of the basic technical scope and teachings of this invention, various amendments will be obvious to a person skilled in the art. Hence, specific configurations are not limited to those of the above embodiments, and any design modifications or uses in different applications within a scope that does not depart from the spirit of this invention are included therein.

What is claimed is:

1. An impeller comprising:

a blade formed either entirely or partially from fiber reinforced plastic;

a boss member that supports said blade;

a plate that presses a root portion of said blade against said boss member; and a fastener that secures said boss member to said plate, wherein said root portion of said blade has an undercut shape, said boss member has an excavated portion for receiving said root portion of said blade, said excavated portion is shaped identically to all or a part of said undercut shape or shaped such that a gap is formed between said excavated portion and all or a part of said undercut shape when said excavated portion receives said root portion of said blade, and said root portion of said blade is fastened by a fastening force via said boss member and said plate such that a clearance is provided between said boss member and said plate, the clearance is located between the boss member and the plate in a direction from the excavated portion to the fastener, the fastener extends through the clearance from the boss member to the plate; and a thickness of said clearance is between 5% and 15% of a minimum value of a thickness of said root portion of said blade in an axial direction.

2. The impeller according to claim 1, which is configured such that when P is set as an axial force required to fasten the blade, m is set as a mass of said blade, r is set as a distance between a center of gravity of said blade and a rotary axis, ω is set as a maximum rotation speed of the blade, a coefficient $\alpha=5$, S is set as a smaller projected area of a projected area of a surface of said root portion of said blade that is fastened from a boss member side and a projected area of a surface of said root portion of said blade that is fastened from a plate side, and β is set as a limit fastening pressure for the blade, $\alpha m r \omega 2 < P < \beta s$ is satisfied.

3. The impeller according to claim 2, wherein a fastened part of said root portion of said blade is not hollow.

4. The impeller according to claim 1, wherein a through hole is not provided in said root portion of said blade, and said fastener is constituted by bolts disposed in a location not penetrating said blade.

5. The impeller according to claim 1, wherein a surface of said root portion of said blade fastened from said plate side is perpendicular to a rotary axis direction.

6. The impeller according to claim 1, wherein said root portion of said blade is formed from fiber reinforced plastic containing chopped fiber.

7. An impeller comprising:

a blade formed either entirely or partially from fiber reinforced plastic;

a boss member that supports said blade;

a plate that presses a root portion of said blade against said boss member; and a fastener that secures said boss member to said plate, wherein said root portion of said blade has an undercut shape, said boss member has an excavated portion for receiving said root portion of said blade, said excavated portion is shaped identically to all or a part of said undercut shape or shaped such that a gap is formed between said excavated portion and all or a part of said undercut shape when said excavated portion receives said root portion of said blade, and said root portion of said blade is fastened by a fastening force via said boss member and said plate such that a clearance is provided between said boss member and said plate, the clearance is located between the boss member and the plate in a direction from the excavated portion to the fastener, the fastener extends through the clearance from the boss member to the plate, said undercut shape provided on said root portion of said blade is configured such that a ratio between a surface area of a narrowest plane of a cross-section of the undercut shape that is orthogonal to a radial direction centering on a rotary axis and a total surface area of a plane of a cross-section of the undercut shape that is orthogonal to a circumferential direction centering on said rotary axis is between 0.5 times and 10 times as large as a ratio of a circumferential direction tensile strength and a radial direction tensile strength of a material forming said root portion of said blade, wherein said plane passes through a fitting portion tip end of said boss member so as to be parallel to said radial direction centering on said rotary axis.

8. An impeller comprising:

a blade formed either entirely or partially from fiber reinforced plastic;

a boss member that supports said blade;

a plate that presses a root portion of said blade against said boss member; and a fastener that secures said boss member to said plate, wherein said root portion of said blade has an undercut shape, said boss member has an excavated portion for receiving said root portion of said blade, said excavated portion is shaped identically to all or a part of said undercut shape or shaped such that a gap is formed between said excavated portion and all or a part of said undercut shape when said excavated portion receives said root portion of said blade, and said root portion of said blade is fastened by a fastening force via said boss member and said plate such that a clearance is provided between said boss member and said plate, wherein a thickness of said clearance is between 5% and 15% of a minimum value of a thickness of said root portion of said blade in an axial direction.

* * * * *